US005352031A

United States Patent [19]

Nahrgang

[11] Patent Number: 5,352,031

[45] Date of Patent: Oct. 4, 1994

[54] STORAGE DRAWER UNIT FOR UNFINISHED STAIRWAY

[76] Inventor: Hugh I. Nahrgang, 1749 Rockhurst La., Cincinnati, Ohio 45255

[21] Appl. No.: 94,257

[22] Filed: Jul. 19, 1993

[51] Int. Cl.[5] ..... A47B 83/00

[52] U.S. Cl. ..... 312/235.1; 182/127; 312/237

[58] Field of Search ..... 312/235.1, 237, 333; 182/129

[56] References Cited

U.S. PATENT DOCUMENTS 676,157 6/1901 Sparks .
2,499,773 3/1950 Owens .
2,563,436 8/1951 Toth ..... 228/30
2,775,499 12/1956 Gleitsman ..... 312/235.1
3,973,814 8/1976 Entrikin ..... 312/333
4,139,077 2/1979 Pena ..... 182/129 X
4,937,902 7/1990 Shapiro ..... 312/235.1 X

*Primary Examiner*—Richard E. Gluck
*Attorney, Agent, or Firm*—Wood, Herron & Evans

[57] ABSTRACT

A storage drawer unit for installation under at least one step of an unfinished stairway. The unit is slidably supported under the step such that it is readily extensible from the front face of the stairway in order to retrieve stored articles.

9 Claims, 1 Drawing Sheet

STORAGE DRAWER UNIT FOR UNFINISHED STAIRWAY

FIELD OF THE INVENTION

The present invention generally relates to storage receptacles, and more particularly to a storage drawer unit for installation under or in an unfinished stairway.

BACKGROUND OF THE INVENTION

In the past, attempts have been made to utilize dead space under one or more horizontal steps for storage purposes. Examples of drawers to be used for storage and adapted for installation under one or more steps may be found in U.S. Pat. Nos. 676,157 and 2,563,436, directed to a stool and step-ladder, respectively. Drawers of these designs are mounted horizontally under one or more steps and are manually slidable by conventional tongue and groove techniques from either a front or rear access to the step. However, notwithstanding these efforts, a storage drawer unit has not been disclosed which uses dead space under or in an unfinished stairway. Furthermore, a storage drawer unit has not been disclosed which is diagonally extensible from the step by hand and safely self-closing under its own weight. Additionally, a storage drawer unit has not been disclosed which facilitates proper registration of the storage drawer under the step during installation and operation.

SUMMARY OF THE INVENTION

Therefore, it is a primary objective of the present invention to disclose and provide a storage drawer unit for installation under or in an unfinished stairway having an inclined front face whereby dead space under one or more steps is used for storage purposes. To this end, a storage drawer is provided to retain articles placed therein whereby the drawer is slidably supported by support means under one or more steps such that the drawer is readily extensible by hand from the inclined front face of the stairway, thereby opening for placement or retrieval of articles therein, and is retractable to a closed position adjacent the inclined front face such that dead space under one or more steps is used for storage purposes.

It is a further objective of the present invention to disclose and provide a storage drawer unit for installation under or in an unfinished stairway whereby the storage drawer is diagonally extensible by hand from the front face of the stairway and safely self-closing under its own weight to the closed position. To this end, a storage drawer is provided whereby the drawer is slidably supported by support means disposed diagonally downward from the inclined front face of the stairway such that the storage drawer is diagonally extensible by hand from the front face of the stairway and safely self-closing under its own weight to the closed position.

It is still another objective of the present invention to disclose and provide a storage drawer unit for installation under or in an unfinished stairway whereby proper registration of the storage drawer is facilitated during installation and operation. To this end, spacer means are provided for accurately spacing the support means from the step such that the spacer means facilitate proper registration of the storage drawer under one or more steps during installation and operation.

BRIEF DESCRIPTION OF THE DRAWINGS

The accompanying drawings, which are incorporated in and constitute a part of this specification, illustrate an embodiment of the invention and, together with the general description of the invention given above and the detailed description of an embodiment given below, serve to explain the principles of the present invention.

DETAILED DESCRIPTION OF THE INVENTION

Figures 1, 2, 3, 4:
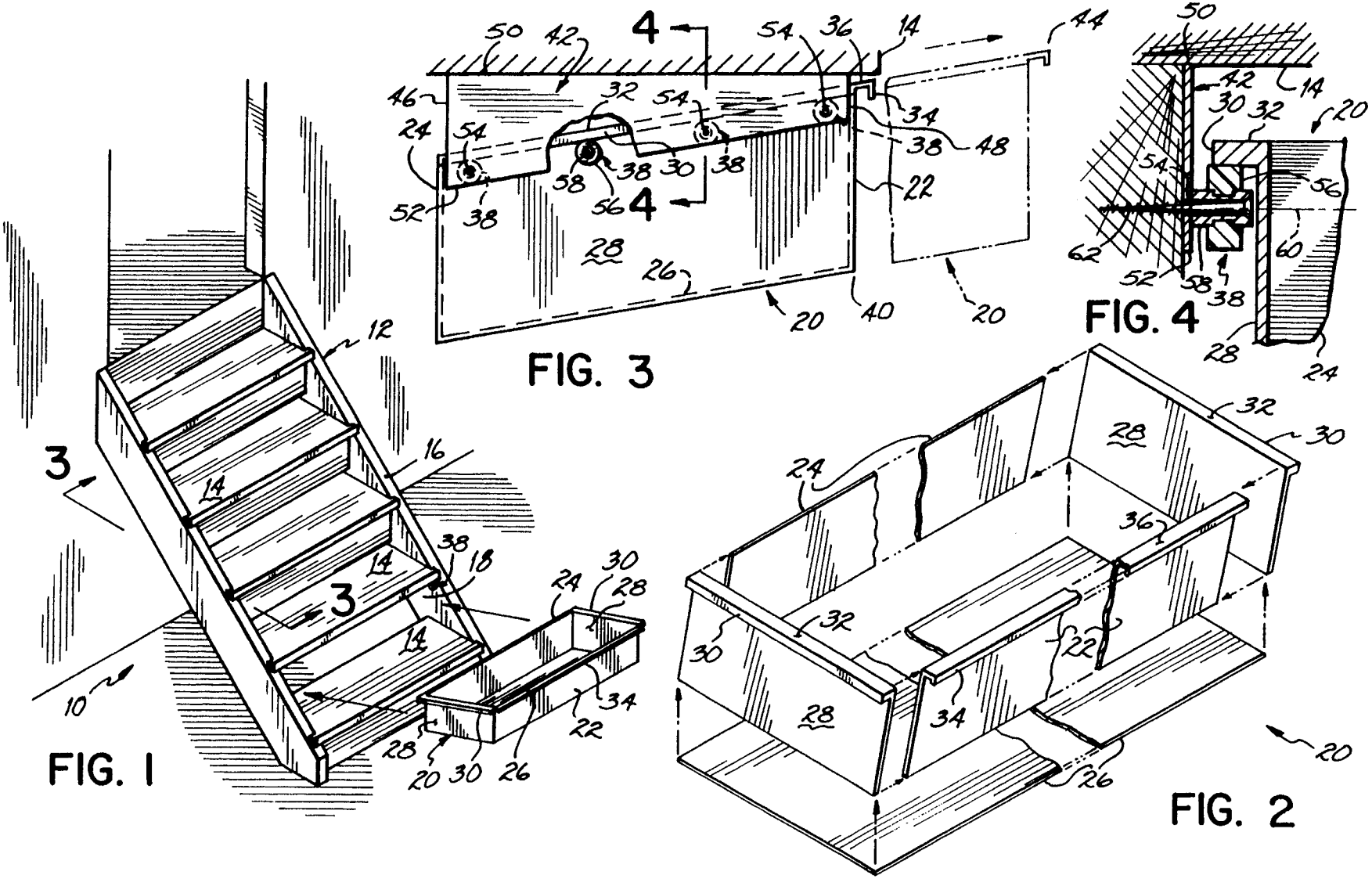
FIG. 1 is a perspective view of a storage drawer unit in accordance with the general principles of the present invention.
FIG. 2 is a disassembled perspective view of the storage drawer shown in FIG. 1 in accordance with the general principles of the present invention.
FIG. 3 is a cross-sectional side view of the storage drawer unit of FIG. 1 taken along lines 3—3.
FIG. 4 is a partial cross-sectional view of the storage drawer unit of FIG. 3 taken along lines 4—4.

Referring now in detail to the drawings, in FIG. 1 there is shown a storage drawer unit 10 in accordance with the general principles of the present invention for installation under or in an unfinished stairway 12. As shown, stairway 12 is built in accordance with standard construction practice and includes horizontal steps 14 arranged in stepped series along an inclined front face 16. Unfinished stairway 12 includes a dead space 18 under at least one of horizontal steps 14 into which storage drawer unit 10 is installed and operated in accordance with the present invention. While stairway 12 is shown in a basement as an exemplary embodiment, it will be appreciated that stairway 12 could represent similarly constructed stairways found at above-ground swimming pools, outdoor patios or the like in equally suitable embodiments of the present invention. Storage drawer unit 10 includes a storage drawer 20 adapted for installation in dead space 18, such as may be found in a common thirty-six inch wide stairway, for example, and is slidably supported under step 14 during use of storage drawer unit 10 as will be described in more detail below with reference to FIGS. 3–4.

As may be seen in FIG. 2, storage drawer 20 includes a front 22, a back 24, a bottom 26 and a pair of opposite sides 28 which are joined by techniques well known in the carpentry art such as by gluing, dovetailing, tongue and groove design, nailing or the like such that storage drawer 20, once assembled, is adapted to retain articles placed therein. It will be appreciated that front 22, back 24, bottom 26 and opposite sides 28 can be constructed as separate components made of plastic, metal wood or the like, or, in an alternative embodiment not shown, storage drawer 20 can be molded from a unitary blank of plastic, sheet metal or the like. Preferably, storage drawer 10 is constructed from separate components such that front 22, back 24 and bottom 26 can be readily cut to varying widths and joined with opposite sides 28 to accomodate stairways of varying widths. In this way, opposite sides 28 may have receiving grooves (not shown) into which front 22, back 24 and bottom 26 are received such that storage drawer 20 can be flexibly and economically manufactured to varying widths.

With further reference to FIG. 2, storage drawer 20 includes support flanges 30 projecting outwardly from and along first top edges 32 of opposite sides 28. Flanges 30 serve to slidably support storage drawer 20 as will be described in more detail below with reference to FIGS. 3–4. Preferably, storage drawer 20 further includes a channel-shaped handle 34 projecting outwardly and downwardly from and along second top edge 36. Handle 34 is provided to facilitate manual grasping of storage drawer 20 during use of storage drawer unit 10 as will be described in more detail below with reference to FIG. 3.

As may be seen in FIG. 3, storage drawer unit 10 includes a plurality of rollers assemblies 38 which slidably support storage drawer 20 along support flanges 30. In a closed position 40, storage drawer front 22 is adjacent inclined front face 16 (not shown). Roller assemblies 38 are adapted to facilitate opening and closing of storage drawer 20 during use of storage drawer unit 10. A pair of spacer flanges 42 (one shown) is provided to accurately space roller assemblies 38 from step 14 such that storage drawer 20 is properly registered under step 14 during installation and operation. Preferably, roller assemblies 38 are disposed diagonally downward from inclined front face 16 (e.g., angularly disposed ten to fifteen degrees from horizontal step 14) such that storage drawer 10 is diagonally extensible from inclined front face 16 by hand, thereby extending to an open position 44 for placement or retrieval of articles therein, and is safely self-closing under its own weight to closed position 40. In this way, storage drawer 20 automatically closes after use and stops in closed position 40.

With further reference to FIG. 3, spacer flanges 42 preferably include a first side edge 46, an opposite second side edge 48 a top edge 50, and a bottom edge 52 wherein first side edge 46 is wider than second side edge 48 such that bottom edge 52 extends diagonally downward from second side edge 48 to first side edge 46. Spacer flanges 42 are disposed under step 14 such that second side edge 48 lies adjacent inclined front face 16 of stairway 12. Furthermore, spacer flanges 42 include a plurality of apertures 54 along bottom edge 52 and coextensive with roller assemblies 38, as will be described in more detail below with reference to FIG. 4. Preferably, storage drawer 20 has support flanges 30 and drawer bottom 26 substantially parallel to roller assemblies 38 and drawer front 22 and drawer back 24 substantially perpendicular to step 14 such that storage drawer 20 is adapted to be diagonally extended from inclined front face 16 along roller assemblies 38. It will be appreciated that roller assemblies 38 and support flanges 30 could be interposed such that roller assemblies 38 are attached to storage drawer 20 and support flanges 30 are attached under step 14. Furthermore, it will be appreciated that roller assemblies 38 and support flanges 30 could be dispensed with and replaced by a Teflon, nylon or the like tongue and groove design (not shown) to provide similar operation of storage drawer unit 10.

In operation, storage drawer 20 is diagonally extended from inclined front face 16 by hand via handle 34 to open position 44, thereby opening for placement or retrieval of articles therein (not shown). Thereafter, upon release of handle 34, storage drawer 20 safely self-closes under its own weight to closed position 40 under step 14.

Referring to FIG. 4, support flange 30 of storage drawer 20 is shown supported by a roller assembly 38. Roller assembly 38 includes a roller 56 rotatably mounted about an axle member 58. Roller 56 and axle member 58 have a common axis of rotation 60. As shown, roller assembly 38 is spaced from step 14 by spacer flange 42 and connected to stairway 12 through aperture 54 by a wood screw 62 extending through axis 60. It will be appreciated that roller assembly 38 may represent many known axle and roller combinations in the art, such as those made of wood, nylon or the like. Furthermore, roller 56 may comprise two seperate roller halves (not shown) which are joined about axle member 58 to form roller assembly 38. In this way, roller assemblies 38 are angulary disposed between ten to fifteen degrees below step 14 through coextensive apertures 54 such that storage drawer 20 is diagonally extensible by hand from inclined front face 16 of stairway 12 and safely self-closing under its own weight to closed position 40 as seen in FIG. 3.

While the present invention has been illustrated by description of various embodiments and while those embodiments have been described in considerable detail, it is not the intention of applicant to restrict or in any way limit the scope of the appended claims to such details. Additional advantages and modifications will readily appear to those skilled in the art. The invention in its broader aspects is therefore not limited to the specific details and illustrative examples shown and described. Accordingly, departures may be made from such details without departing from the spirit or scope of applicant's invention.

Having described the invention, what is claimed is:

1. A storage drawer unit for installation under at least one step of an unfinished stairway having an inclined front face, comprising:

a drawer adapted to fit under said step, said drawer having a front, a back, a bottom, and a pair of opposite sides to retain articles placed therein, said drawer front being adjacent said inclined front face when said drawer is in a closed position; and support means mounted under said step for slidably supporting said drawer such that said drawer is readily extensible from said inclined front face by hand thereby opening for placement or retrieval of articles therein and is retractable to said closed position.

2. The storage drawer unit of claim 1, said support means being disposed diagonally downward from said inclined front face such that said drawer is diagonally extensible from said front face by hand and is safely self-closing under its own weight to said closed position.

3. The storage drawer unit of claim 2 further including spacer means for accurately spacing said support means from said step whereby said spacer means facilitates proper registration of said drawer under said step during said installation.

4. The storage drawer unit of claim 3 wherein said support means comprises a plurality of rollers adapted to facilitate opening and closing of said drawer.

5. A storage drawer unit for installation under at least one step of an unfinished stairway having an inclined front face, comprising:

a drawer adapted to fit under said step, said drawer having a front, a back, a bottom, and a pair of opposite sides to retain articles placed therein, said drawer front being adjacent said inclined front face when said drawer is in a closed position;

support means mounted under said step for slidably supporting said drawer such that said drawer is readily extensible from said inclined front face by hand thereby opening for placement or retrieval of articles therein and is retractable to said closed position; and spacer means for accurately spacing said support means from said step whereby said spacer means facilitates proper registration of said drawer under said step during said installation.

6. The storage drawer unit of claim 5, said support means being disposed diagonally downward from said inclined front face such that said drawer is diagonally extensible from said front face by hand and is safely self-closing under its own weight to said closed position.

7. The storage drawer unit of claim 6 wherein said support means comprises a plurality of rollers adapted to facilitate opening and closing of said drawer.

8. A storage drawer unit for installation under at least one step of an unfinished stairway having an inclined front face, comprising:

a drawer adapted to fit under said step, said drawer having a front, a back, a bottom, and a pair of opposite sides to retain articles placed therein, said drawer front being adjacent said inclined front face when said drawer is in a closed position;

a plurality of rollers mounted under said step for slidably supporting said drawer such that said drawer is readily extensible from said inclined front face by hand thereby opening for placement or retrieval of articles therein and is retractable to said closed position; and a pair of spacer flanges mounted opposingly under said step for accurately spacing said plurality of rollers from said step whereby said spacer flanges facilitate proper registration of said drawer under said step during said installation.

9. The storage drawer unit of claim 8, said plurality of rollers being disposed diagonally downward from said inclined front face such that said drawer is diagonally extensible from said front face by hand and safely self-closing under its own weight to said closed position.

* * * * *